US005551210A

United States Patent [19]

Williamson

[11] Patent Number: 5,551,210

[45] Date of Patent: Sep. 3, 1996

[54] MACHINE FOR PACKAGING PRODUCT

[76] Inventor: Robert L. Williamson, 67602 62nd St., Hartford, Mich. 49057

[21] Appl. No.: 414,581

[22] Filed: Mar. 31, 1995

[51] Int. Cl.[6] ..... B65B 1/06; B65B 7/26; B65B 39/00; B65B 43/39

[52] U.S. Cl. ..... 53/282; 53/248; 53/249; 53/289; 53/377.6; 53/381.4; 53/382.1

[58] Field of Search ..... 53/281, 282, 248, 53/250, 468, 376.3, 377.6, 382.1, 289, 486, 290, 249

[56] References Cited

U.S. PATENT DOCUMENTS

| | | | |
|---|---|---|---|
| 3,295,293 | 1/1967 | Lodding | 53/486 |
| 3,412,526 | 11/1968 | Bennert et al. | 53/290 X |
| 3,487,622 | 1/1970 | Mueller | 53/289 X |
| 3,513,621 | 5/1970 | Chamberlin | 53/468 |
| 3,638,391 | 2/1972 | Fluck | 53/382.1 X |
| 4,038,807 | 8/1977 | Beardsley et al. | 53/282 |
| 4,459,791 | 7/1984 | Booth | 53/290 |
| 4,807,425 | 2/1989 | Abrams | 53/468 |

*Primary Examiner*—Horace M. Culver
*Attorney, Agent, or Firm*—Baker & Daniels

[57] ABSTRACT

A machine for packaging product, such as blueberries and other similar small fruits in a container having a receptacle and a lid connected to the receptacle includes a hopper suspended over a conveying mechanism which conveys the container beneath the dispensing opening of the hopper to fill the container. The size of the dispensing opening is set for the speed of the line and the size of the container by adjusting the position of a movable wall of the hopper. The containers are then conveyed to a closing station at which the lids are closed and latched by applying pressure to the lid while one side of the container is deflected to move the corners away from the lid to thereby permit closing of the container.

17 Claims, 9 Drawing Sheets

MACHINE FOR PACKAGING PRODUCT

This invention relates to a machine for packaging product such as blueberries and other small fruit. Thin plastic containers have become increasingly popular as containers for small products, such as blueberries and other small fruit. These containers include a "clam shell" lid which is attached to one edge of the container and thus may be moved from an open position to a closed position in which the corners of the lid engage the corners of the receptacle to thereby close the container until it is opened by the consumer. Commonly, the plastic from which the container is made is sufficiently flexible that the sides of the container are easily deflected when the container is empty and is transparent to permit the contents to be readily examined by the consumer. However, filling and processing the containers has proven to be difficult and requires much hand labor. It has proven to be particularly difficult to automatically close the lid and latch the lid of the container in a consistent manner by use of automatic equipment. Accordingly, production costs in packaging products in containers of this type have proven to be high. Although the machine disclosed herein is particularly suitable for packaging blueberries and other small fruits, it can also be used for any :other suitable food product (such as cranberries), and possibly small non-food products. Furthermore, prior art hoppers used to feed product into containers often sheared, bruised and damaged product such as blueberries or other small fruit. The present invention prevents damage to product as it is fed from the hopper into the containers by permitting adjustment of the size of the dispensing opening through which product is fed and by providing a baffle to regulate flow through the opening.

The present invention provides a machine which supports a conveying mechanism which conveys the containers between a dispensing station and a closing station. Products are dispensed through a hopper into the container as the latter are transported through the conveying station with their clam shell lids held open. As the containers are transported from the dispensing station to the closing station, the lids are moved to a position overlying the product receiving receptacle portion of the container. A serrated wheel rotatably mounted adjacent the transport path applies pressure to the sides of the receptacle opposite the side to which the hinge is attached, thereby depressing the side and deflecting the corners. A pressure member then applies pressure to the lid to force it over the corners, so that when the pressure on the side is released, the corners relax into a position engaging the lid. Accordingly, the container is filled, and the lid is closed automatically.

These and other advantages of the present invention will become apparent from the following description, with reference to the accompanying drawings, in which.

Figure 1:
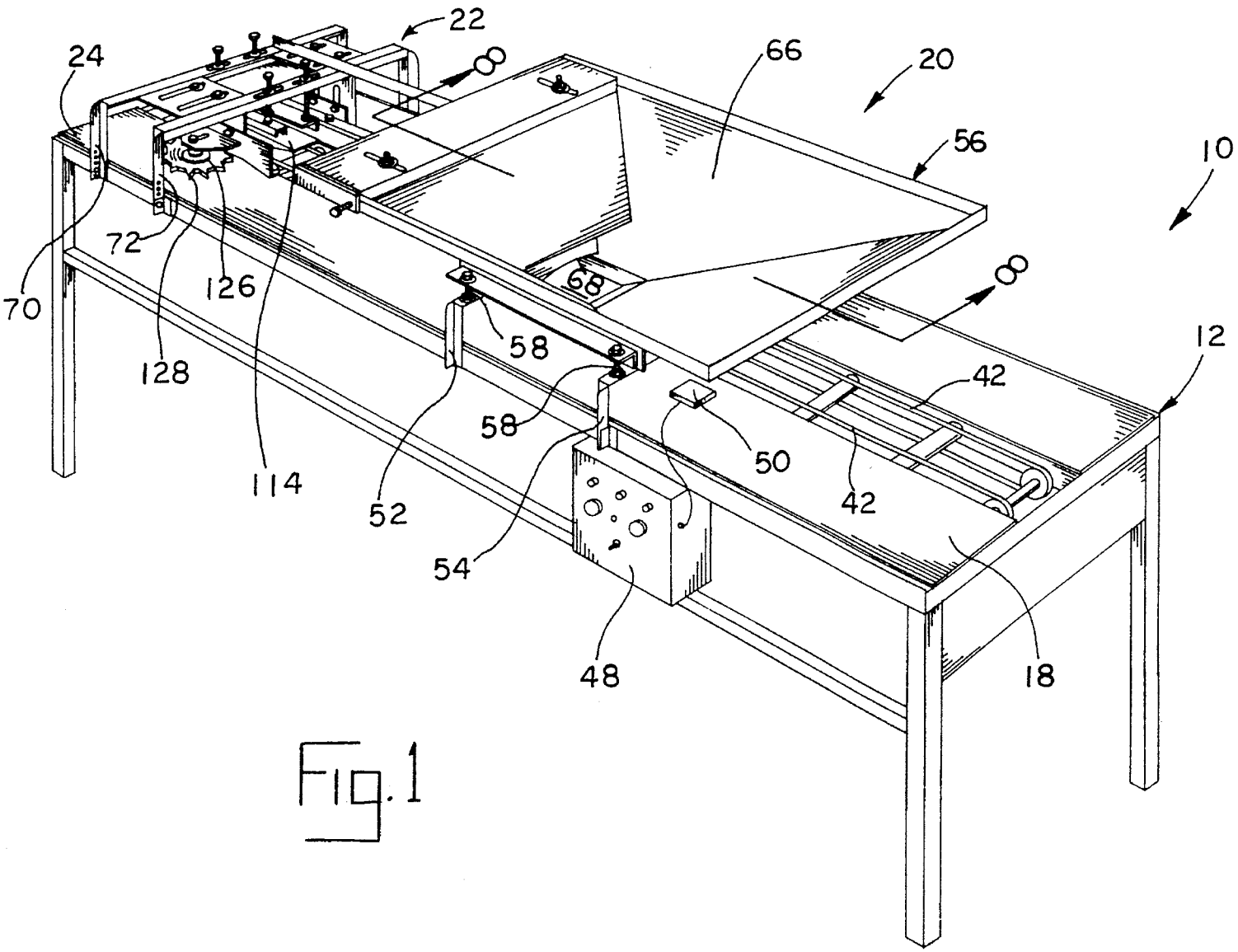
FIG. 1 is a view in perspective of a machine made pursuant to the teachings of the present invention.
Figure 2:
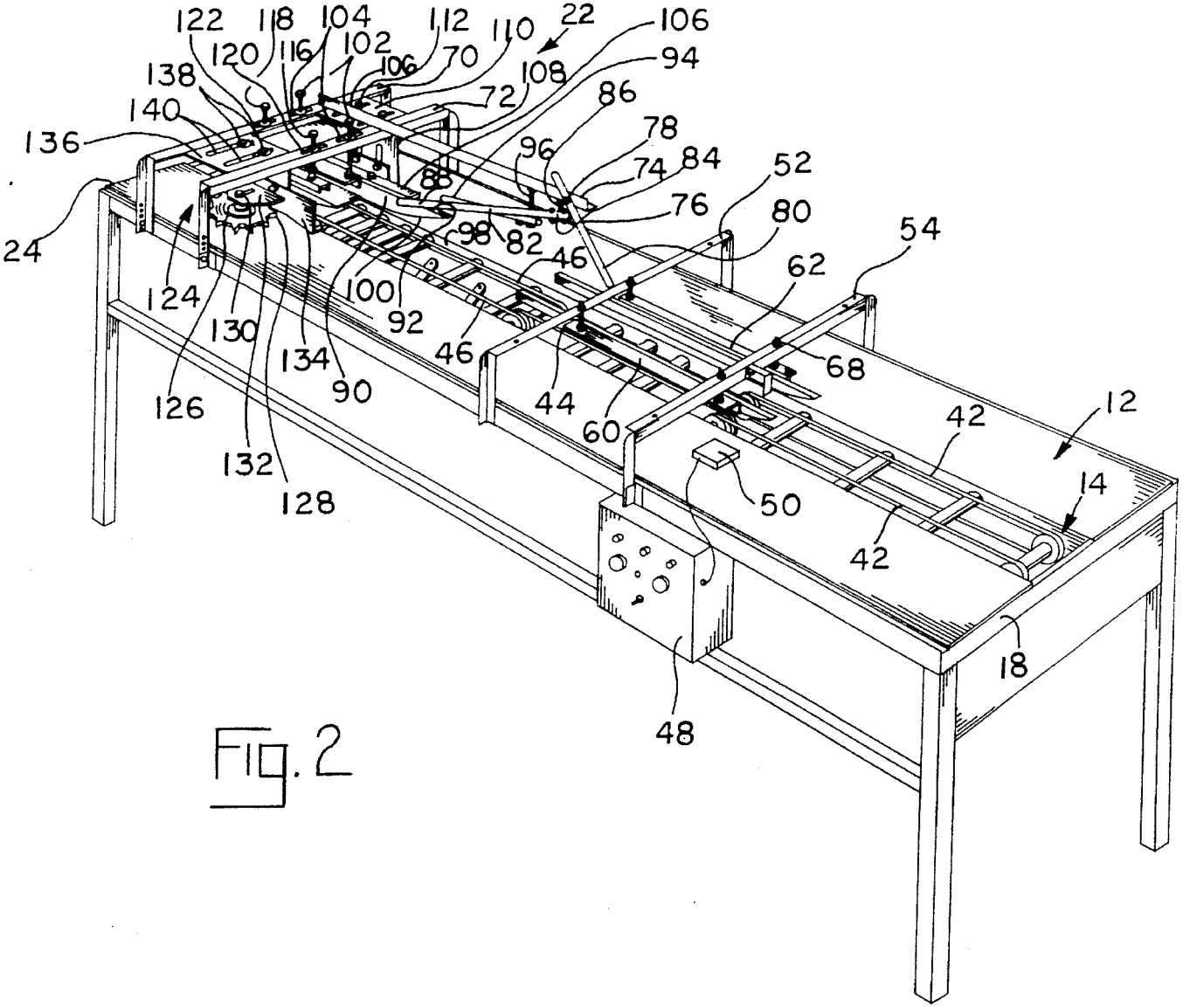
FIG. 2 is a fragmentary perspective view similar to FIG. 1 but illustrating the machine of the present invention with the hopper removed.

Referring now to the drawings, the machine generally indicated by the numeral 10 includes a fixed support or table 12 upon which the various components of the machine 10 are mounted. A conveying mechanism generally indicated by the numeral 14 transports containers generally indicated by the numeral 16 from the end 18 of the support 12, where they are deposited on the conveying mechanism 14 by an operator, through a dispensing station generally indicated by the numeral 20 and then to a closing station generally indicated by the numeral 22. After the containers 16 pass through the closing station 22, they are removed from the opposite end 24 of the supporter table 12 by another operator.

Containers 16 include a lid generally indicated by the numeral 26 and a receptacle portion generally indicated by the numeral 28. The receptacle 28 receives the fruit to be packaged in the container 16 and includes a pair of opposite sides 30, 32 which are interconnected by sides 34, 36. A hinged connection 38 connects the lid 26 to the side 32. The lid 26 includes a dependent portion 40 which latches over the corners defined between the walls 30, 32, 34, and 36 of the receptacle portion 28. The conveying mechanism 14 includes a first set of conveying belt 42 which transport the container 16 from the end 14 to the dispensing station 20, a second set of conveying belt 44, which transport the containers 16 through the dispensing station 20, and a third set of conveying belts 46 which transport containers 16 from the dispensing station 20 through the closing station 22 and to the end 24 of the table or fixed support 12. The belts 44 are driven at a speed slower than the speed at which the belts 42 and 46 are driven. Belts 42 are coated such that they may slip relative to the containers 16 so that the belts 42 transport the containers 16 to the dispensing station 20 at a faster rate than the containers 16 are transported through the dispensing station 20. Accordingly, it will be assured that the side edges 34, 36 of adjacent containers are engaged with one another as the Containers through the dispensing station 20. Accordingly, product will not spill between the containers. The belts 42, 44, 46 are conventional and are driven by a conventional electric motor through a conventional drive well known to those skilled in the art which permits driving the belts 42, 44, and 46 at differential speeds as described above. Since the conveying mechanism is otherwise conventional, it will not be described in detail herein. The conveying system is controlled by controls mounted on control panel 48. An electric eye 50 is mounted on the fixed support 12 and interrupts power to the conveying mechanism when containers are not present at the entrance to the dispensing station 20. Accordingly, fruit is prevented from being dropped through the table 12.

Figure 3:
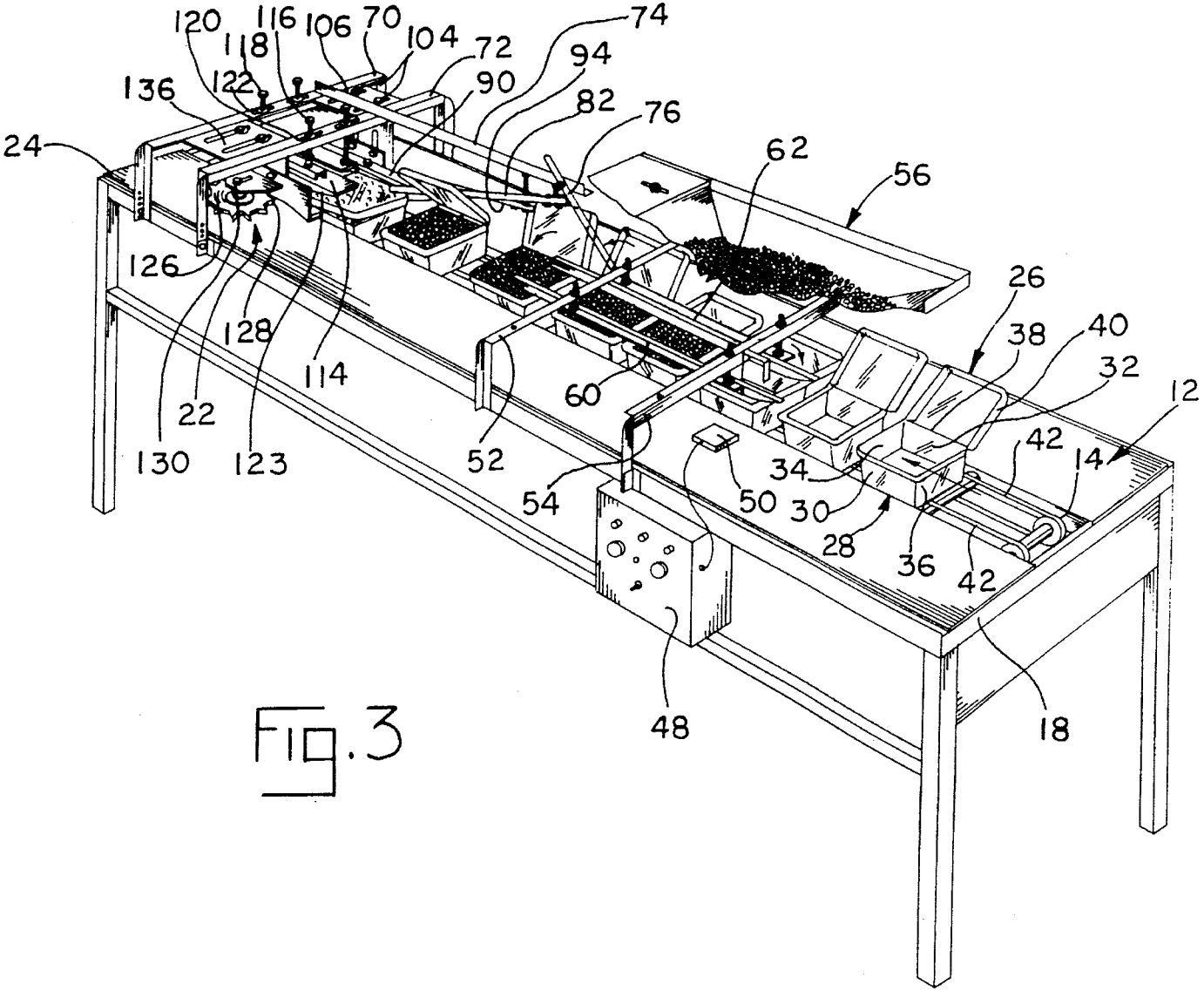
FIG. 3 is a fragmentary view in perspective similar to the FIGS. 1 and 2 but illustrating the hopper broken away and further illustrating schematically the manner in which the containers are filled and the lids of the containers are closed and latched by the machine according to the present invention.
Figure 4:
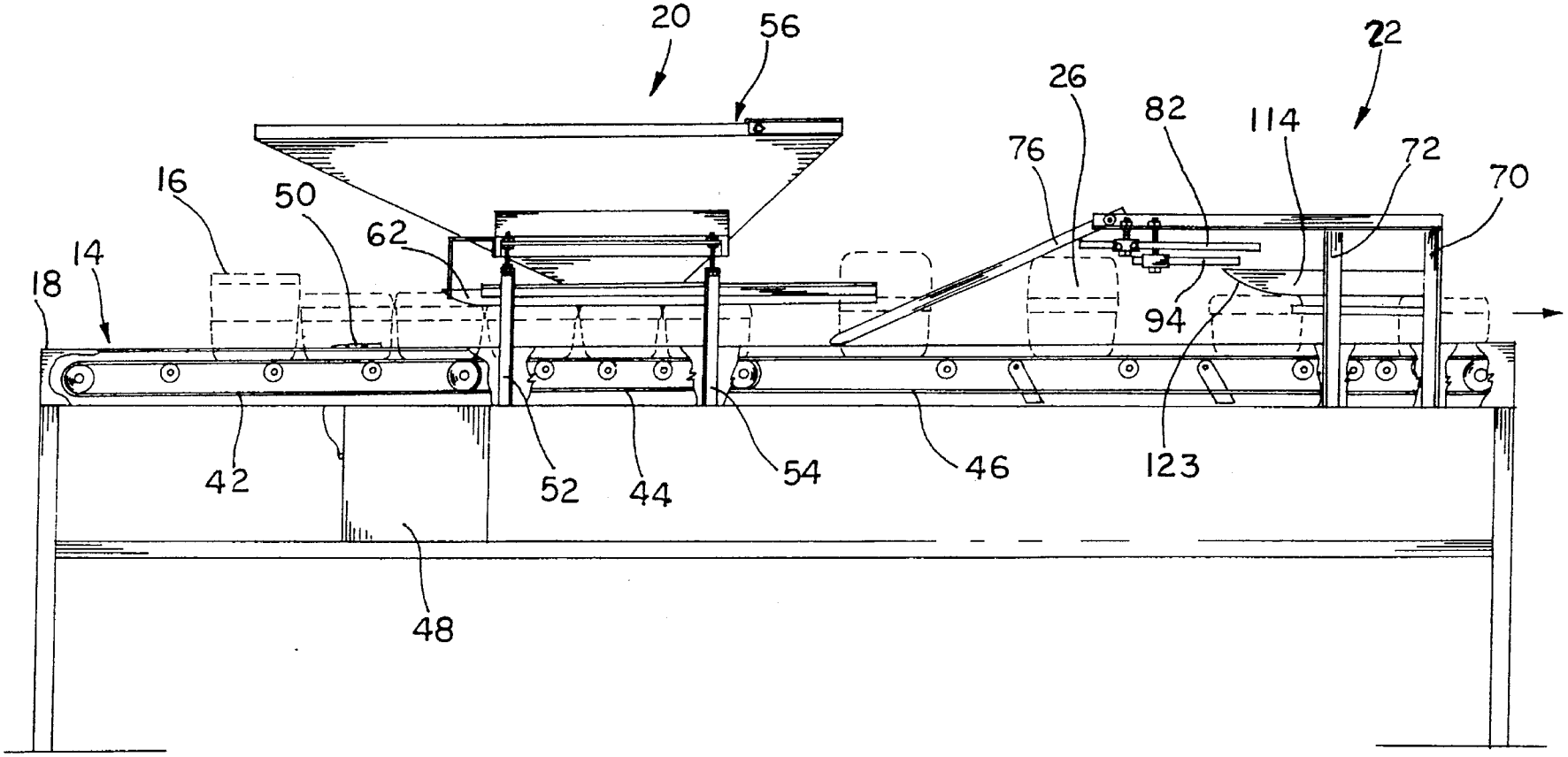
FIG. 4 is a side elevational view partly in cross section, of the machine illustrated in the FIGS. 1–3 taken from the right side viewing FIG. 1, with the containers illustrated by dashed lines.

The dispensing station 20 includes a pair of supports 52, 54 which are carried by the table 12 and which extend transversely with respect to conveying mechanism 14. A hopper 56 which will be described in detail hereinafter is mounted on the supports 52, 54, through conventional adjusting bolts 58 through which the hopper 56 may be raised and lowered with respect to the table 12. A pair of rails 60, 62 are suspended from the supports 52, 54 by adjusting bolts 64 so that the height of the rails 60, 62 with respect to the table 12 may be adjusted. The rails 60, 62 extends substantially parallel to the conveying mechanism 14. As most clearly shown in FIG. 3, the rail 62 is adjusted so that it engages the containers 16 with a minimal clearance at substantially the hinge 38. The rail 60 engages the sides 34, 36 of the container 16 just inside of the side 30. Accordingly, the rail 62 is effective to hold the lid 26 of the container 16 in the fully open position, and the rail 60 prevents tipping of the containers 16 as they are transported under the hopper 56. The hopper 56 includes a large feed opening 66 which feeds product through a smaller dispensing opening 68. As will hereinafter be described, the size of dispensing opening 68 is adjustable, so that product can feed into the receptacles 28 of containers 16 at a rate sufficient to fill the containers as they are transported below the hopper 56 by the conveying mechanism 14. Since, as described above, the containers 16 are transported through the dispensing station 20 with the sides of the containers engaged with one another and since the size of the dispensing opening 68 has been adjusted in accordance with the volume of the containers 16, product may be fed continuously through the hopper 56 into the containers 16 as long as containers are available to dispense the product into.

The closing station 22 includes a pair of longitudinally spaced, transversely extending support members 70, 72 which extend over the conveying mechanism 14 adjacent the end 24 of the table or fixed support 12. A longitudinally extending support member 74 is mounted on brackets 70, 72 and is supported thereby to project toward the dispensing station 20. A rod 76 is secured to the support member 74 as at 78 and projects obliquely with respect thereto toward the conveying mechanism 14. The end 80 of the rod rests on the table 12. Another obliquely extending rod 82 extends from the support 74 adjacent its attachment with the rod 76. Rod 82 projects toward the portion of conveying mechanism 14 at the closing station 22. One end 84 of the rod 82 is secured to the support 74 through an adjustable bolt 86. The angle of the rod 82 may be adjusted by pivoting around the fastener 86, and the height of the rod 82 may be adjusted relative to the notch 92 and to the support member 74 through operation of the fastener 86. Another rod 94 is supported adjacent to, but just below, the rod 82. The rod 94 is hung from the support 74 through an adjustable fastener 96. Accordingly, the angle and height of the rods 82 and 94 with respect to the support 74 and conveying mechanism 14 may be adjusted by operation of the fasteners 86 and 96. Therefore, the rod 82 applies closing pressure at a point farther from the hinge 38 than does the rod 94, thereby assuring proper closing of the lid.

A pressure member 90 is suspended over the conveying mechanism 14 just inside of the edge 98 thereof. Pressure responsive member 90 includes a curved tapering surface 100 that is adapted to engage the lid 26 of containers 16 as will hereinafter be explained. Pressure member 90 is suspended over the conveying means 14 by adjustable fasteners 102 which are mounted for transverse movement relative to the support 70, 72 through slots 104, on supports 70 and 72. Accordingly, the member 90 may be adjusted both transversely and vertically with respect to the conveying mechanism 14. Closing station 22 further includes a contoured member 114 which is suspended directly over the conveying mechanism 14 by adjustable hangers 116, 118 that are able to adjust the vertical position of the pressure member 114 and provide adjustment transverse to the conveying mechanism 14 because of the oversized slots 120, 122, which receive the hangers 116, 118. Contoured member 114 includes a tapering portion 123 which engages the lid 26 of the container 16 as the latter passes through closing station 22. A third pressure member 106 is mounted on a bracket 108 which is hung from bracket 110 on supports 70, 72 through fasteners 112. The pressure member 106 engages the face 113 of dependent portion 40 of lid 16.

Figure 5:
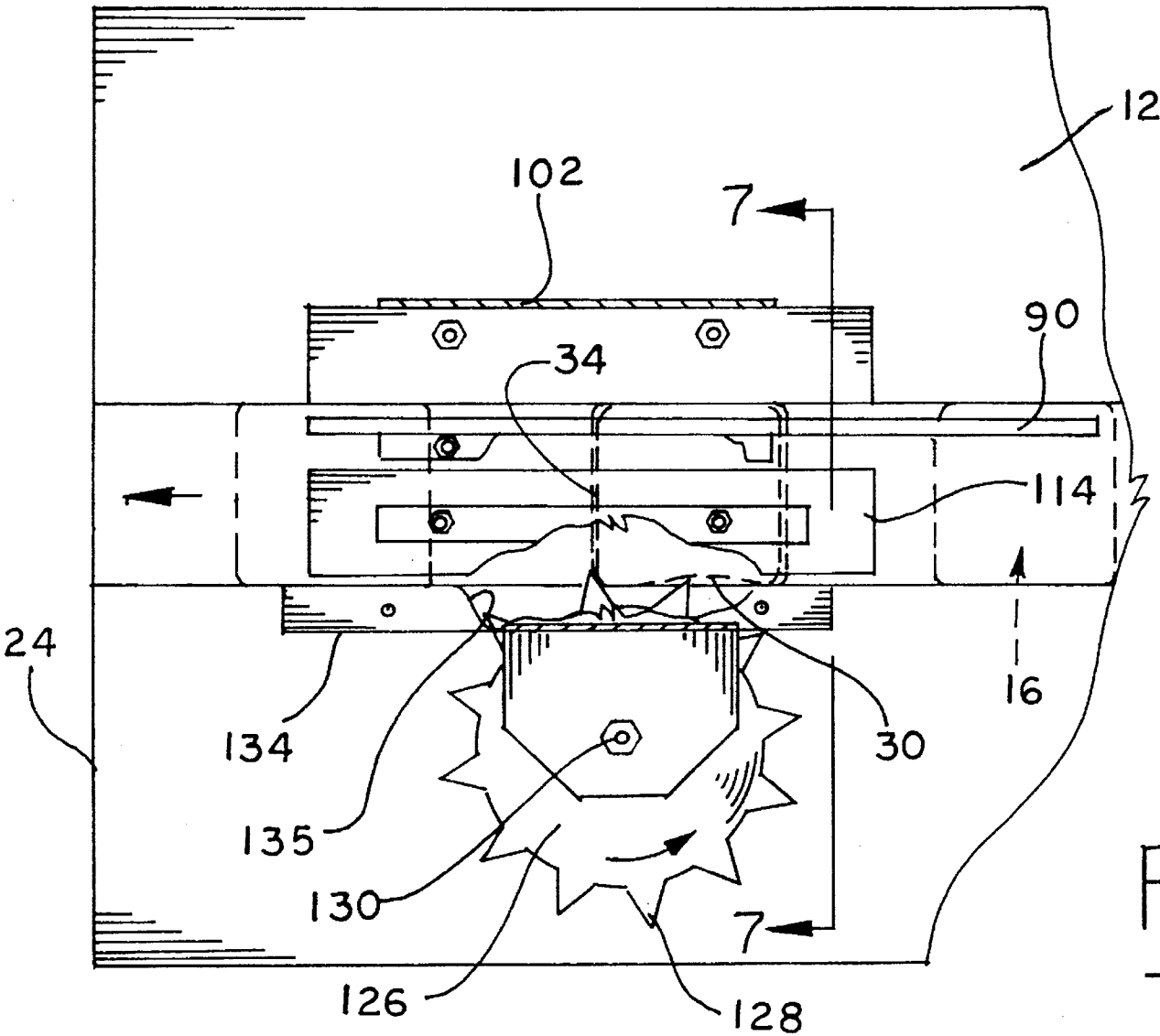
FIGS. 5 and 6 are fragmentary cross sectional views taken substantially along lines 5—5 of FIG. 4 illustrating the manner in which the containers are closed in the closing station of the machine illustrated in FIGS. 1–4.
Figure 6:
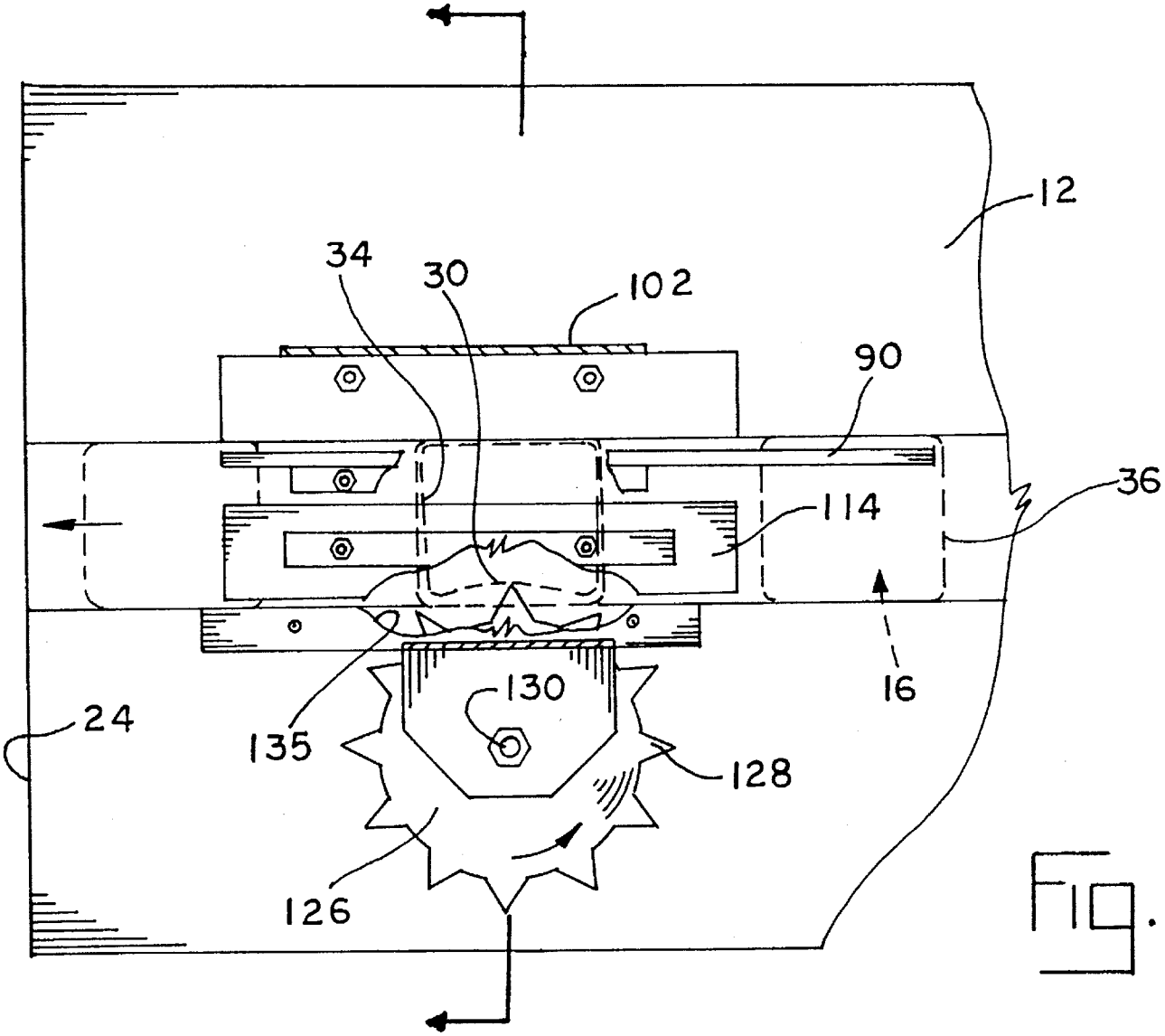
Figure 7:
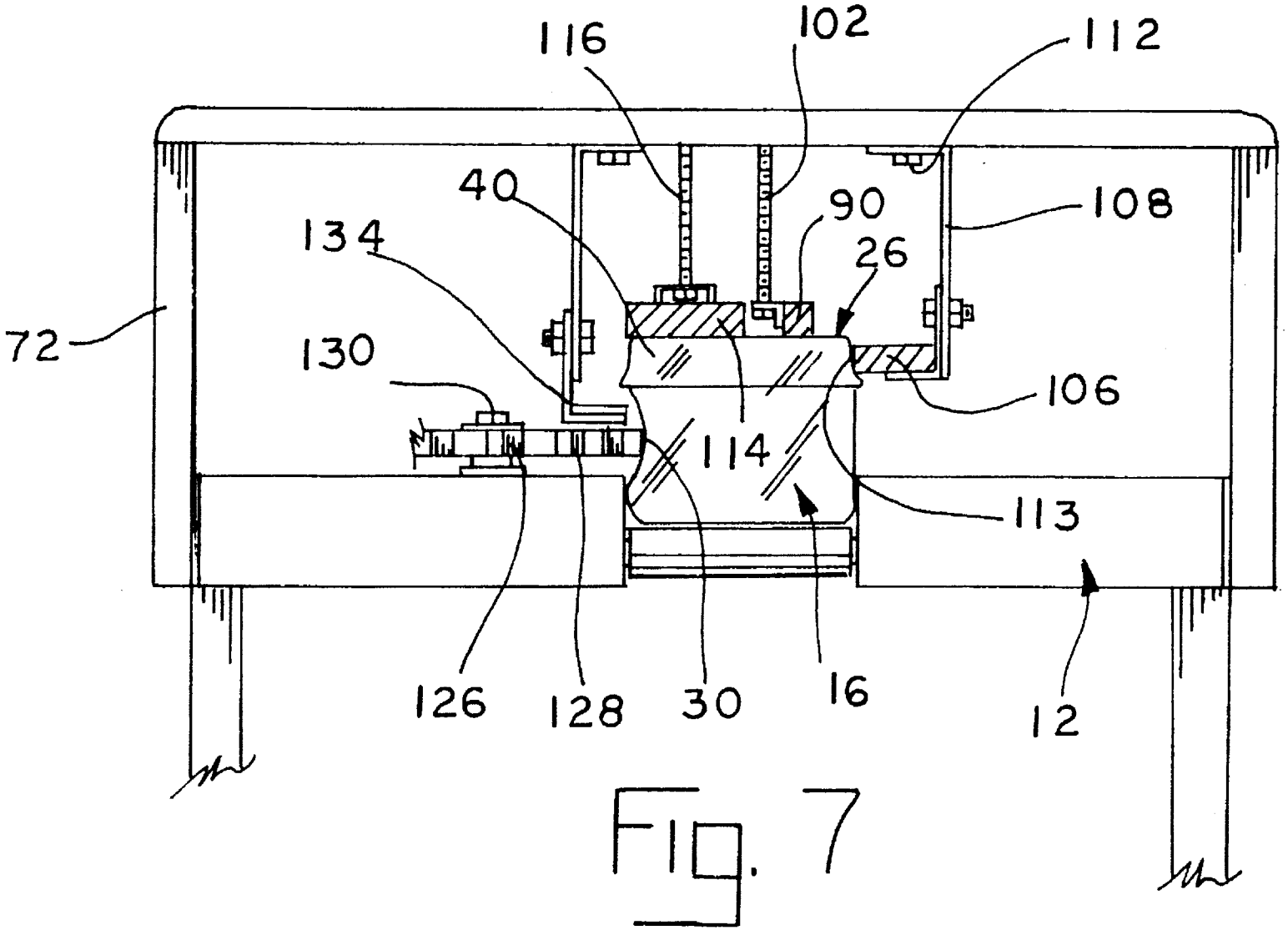
FIG. 7 is a fragmentary cross-sectional view taken substantially along lines 7—7 of FIG. 5.

Closing station 22 further includes a deflecting mechanism generally indicated by the numeral 124. Deflecting mechanism 124 includes a wheel 126 having circumferentially spaced projections or teeth 128 extending therefrom. The wheel 126 is freely rotatable about an axle 130 which is supported in bracket 132. Bracket 132 is secured to guide bracket 134, which is mounted to bracket 136 extending between the support member 70, 72 by fasteners 138 received in slots 140 to prevent transverse adjustment of the deflecting mechanism 124. As most clearly illustrated in FIGS. 5 and 6, the teeth 128 of the wheel 126 extend through an opening 135 in the bracket 134 to engage the sides 30 of the containers 16 as they pass through the station 22. As shown in FIG. 5, the forward edge 34 of containers 16 engage one of the teeth 128 just as the containers enter the closing station 22, thereby effecting rotation of the wheel 126 to cause an adjacent tooth 128 to engage the center of face 30, as shown in FIG. 6.

As the containers 16 are filled with product at dispensing station 20, the lids 26 are held away from the opening into the receptacle 28 by the rail 62. As a container 16 travels past the dispensing opening 68, rod 76 engages the lid 26, thereby gradually turning the lid 26 about the hinge 38 as the container travels from the dispensing station toward the closing station 22. When the forward end of the lid 26 engages the rod 82, the rod 82, which extends obliquely toward the conveying mechanism 14, cooperates with rod 94 to gradually turn the lid to a position overlying the opening into the receptacle 28 as most clearly illustrated in FIG. 3. At this time, the pressure member 90 engages that portion of the lid 26 adjacent the hinge 38 and the pressure member 106 engages face 113 of dependent portion 40 of lid 26, thereby causing the lid to close over the corners defined between the sides 32, 34 and 32, 36. As the container 16 is transported further into the closing station 22, the contoured member 114 engages the lid 26 at a point between the point of engagement of the pressure responsive member 90 and the side 30. At the same time, as most clearly illustrated in FIG. 5, the container engages one of the teeth 128 thereby rotating the wheel 126 such that an adjacent tooth engages the side 30 of the container 16. Since the containers are made, as described above, out of a flexible plastic material adjacent tooth 128 deflects the side 30 as indicated by the dotted lines in FIG. 6. Accordingly, the comers between the sides 30, 34 and 30, 36 are also deflected inwardly, permitting the contoured member 114 to deflect the lid 26 into its fully closed position while the aforementioned corners formed by the side 30 remain deflected. The corners are released as the container 16 is transported away from the wheel 126 by the conveying mechanism 14. The container 16 then leaves the closing station 22, and is removed from the conveying mechanism 14 by an operator standing adjacent end 24 of the machine 10.

Figure 8:
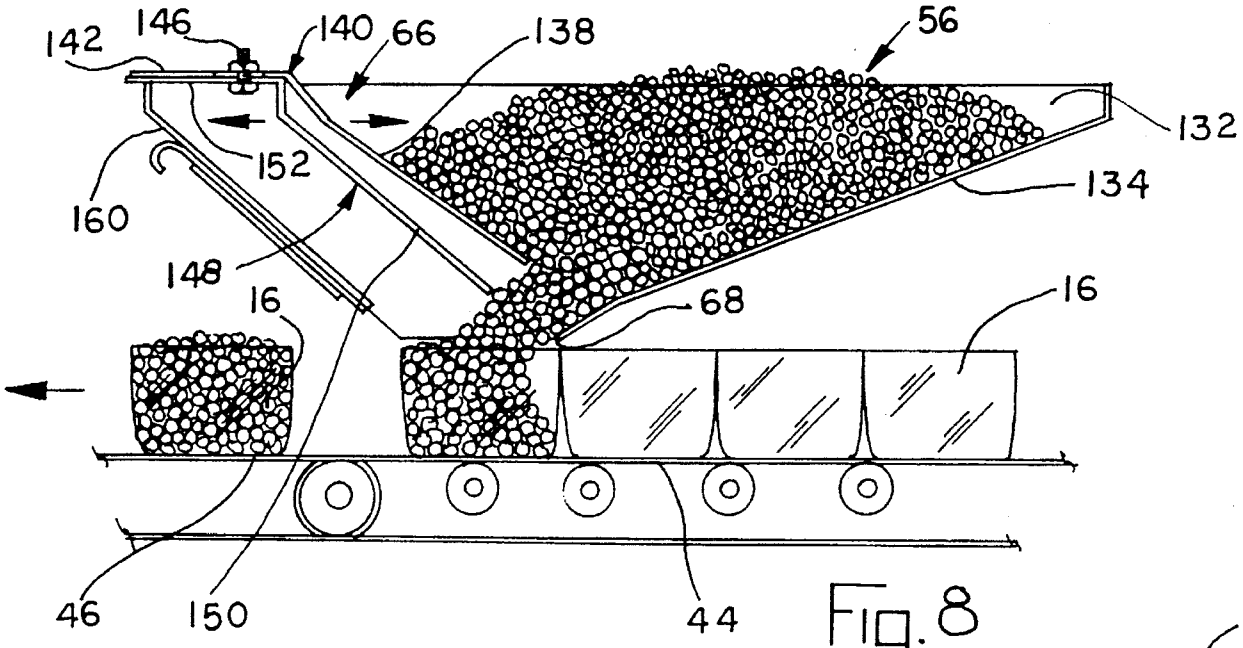
FIGS. 8 and 9 are is a fragmentary cross sectional views taken substantially along lines 8—8 of FIG. 1.
Figure 9:
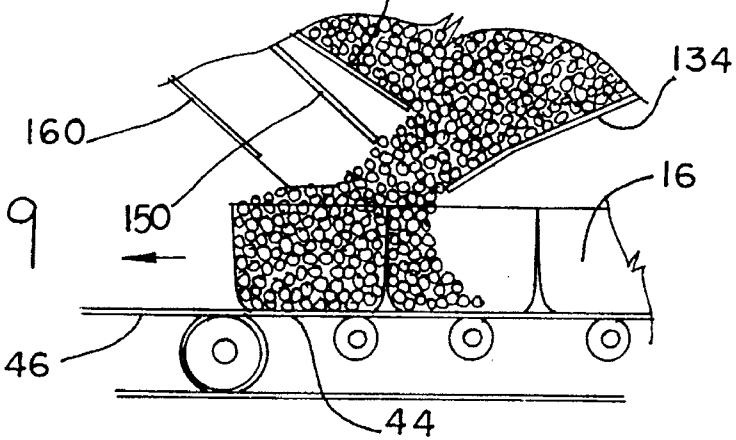
Figure 10:
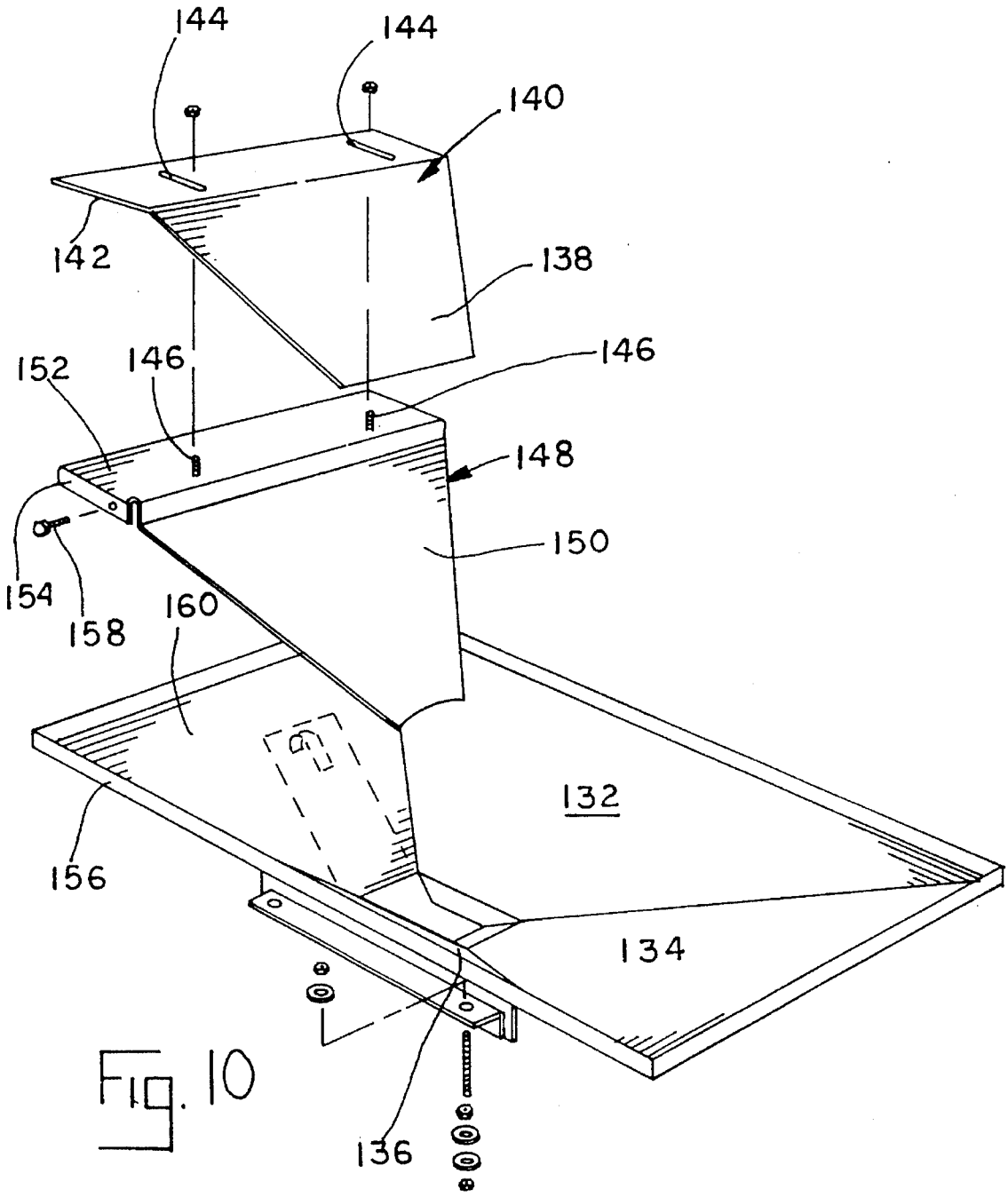
FIG. 10 is an exploded view in perspective of the hopper used in the machine illustrated in FIG. 1.

Referring now to the hopper 56 as illustrated in FIGS. 8–10, the hopper 56 includes four inwardly tapering sides 132, 134, 136, and 138 which define a path between the feed opening 66 and the dispensing opening 68. The side 138 is defined upon a movable baffle generally indicated by the numeral 140 which includes a flange 142 which projects from the side 138 and includes slots 144 which are received on threaded fasteners 146 defined on a movable member generally indicated by the numeral 148. Movable member 148 includes a baffle portion 150 which extends into the feed opening 66 and a flange 152 projecting therefrom which includes downwardly turned lips 154 on opposite sides thereof which are adapted to slidingly engage a rim 156 along the sides 132 and 136. Accordingly, the movable side 148 can be moved toward and away from fixed side 160 of the hopper 56 to thereby adjust the size of the dispensing opening 68. A fastener 158 secures the flange 154 on rim 156. After the size of the dispensing opening 68 is established as necessary depending upon the speed of the belt 44 and the size of the containers 16, the baffle 140 can then be adjusted to regulate the rate of flow of product through the opening and to prevent product from accumulating, for example, in the volume defined between the fixed side 160 and the movable side 148. As most clearly shown in FIG. 9, the fact that the side of the containers 16 are engaged with one another as they pass beneath the dispensing opening 68, the product can flow continuously into the adjacent conveyors without spilling, assuming that the size of the dispensing opening 68 is set properly for the speed of the belt 44 and the size of the containers 16.

I claim:

1. Machine for packaging product in a container having a receptacle and a lid connected to said receptacle for closing said receptacle comprising a support, dispensing means mounted on said support for dispensing product into said receptacle, closing means mounted on said support for closing and latching said lid on said receptacle, and conveying means carried by said support for transporting said container between said dispensing means and said closing means, said receptacle having sides connected by corners at the ends of each of said sides, said closing means including deflecting means for deflecting one of said sides and the corners at the ends of said one side and means for applying pressure to said lid while said corners at the ends of said one side are deflected to permit the lid to close over said corners, said deflecting means including a wheel rotatably mounted on said support, said wheel having teeth extending from said wheel and rotatable therewith, said teeth engaging said one side of said receptacle to deflect the latter in response to rotation of the wheel.

2. Machine for packaging product as claimed in claim 1, wherein said teeth extend over said conveying means to engage said containers being transported by said conveying means, said pressure applying means includes a contoured member mounted on said support for forcing said lid over said corners as one of said teeth deflects said one side.

3. Machine for packaging product as claimed in claim 2, wherein said contoured member is suspended over said conveying means.

4. Machine for packaging product as claimed in claim 1, wherein another of said sides cooperate with the side of the container opposite said one side to define a pair of other corners therebetween, said lid being connected to said opposite side by a hinged connection, and a pressure member engaging the portion of said lid at said corners to close said lid over said corners.

5. Machine for packaging product as claimed in claim 4, wherein a lid folding mechanism engages said lid as said container is conveyed by said conveying means from said dispensing means to said closing means, said mechanism folding said lid about said hinged connection from a fully open position in which substantially unimpeded access into said container is permitted to a position in which the lid overlays said receptacle.

6. Machine for packaging product as claimed in claim 5, wherein said mechanism includes a rod mounted obliquely with respect to said conveying means whereby said rod engages and turns said lid about said hinged connection as the conveying means conveys the container from said dispensing means to said closing means.

7. Machine for packaging product as claimed in claim 4, wherein said conveying means conveys said container to said pressure member before conveying said container to said pressure applying means.

8. Machine for packaging product as claimed in claim 5, wherein said dispensing means includes rail means mounted over the conveying means for engaging said lid to hold said lid in a fully open position.

9. Machine for packaging product as claimed in claim 1, wherein said dispensing means includes a hopper mounted over the conveying means, said hopper having an open end for receiving product and a dispensing opening dispensing product into said containers, and side walls tapering between the open end and the dispensing opening and defining a volume receiving said product.

10. Machine for packaging product as claimed in claim 9, and means for adjusting the distance between the hopper and the conveying means.

11. Machine for packaging product as claimed in claim 9, wherein said side walls include a first pair of opposing side walls and a second pair of opposing side walls interconnecting the first pair of opposing side walls, one of said first pair of side walls being movable relative to the second pair of side walls toward and away from the other of said first pair of side walls to thereby adjust the size of said dispensing opening.

12. Machine for packaging product as claimed in claim 11, wherein said hopper includes a baffle extending into said volume from one of said side walls to regulate the rate of flow of product through said dispensing opening.

13. Machine for packaging product as claimed in claim 12, wherein the position of said baffle within said volume is adjustable relative to said side walls.

14. Machine for packaging product in a container having a receptacle and a lid connected to said receptacle for closing said receptacle comprising a support, dispensing means mounted on said support for dispensing product into said receptacle, and conveying means carried by said support for transporting said container to and from said dispensing means, said dispensing means including a hopper mounted over the conveying means, said hopper having an open end for receiving product and a dispensing opening for dispensing product from said hopper into said containers, a first pair of opposing walls and a second pair of opposing walls interconnecting the first pair of opposing walls, said first and second pair of walls defining a volume therebetween, said hopper including a baffle extending into said volume from one of said walls to regulate the rate of flow of product through said dispensing opening, said one of said walls being movable relative to the second pair of walls toward and away from the other of said first pair of walls to thereby adjust the size of dispensing opening.

15. Machine for packaging product as claimed in claim 14, wherein the position of said baffle within said volume is adjustable relative to said walls.

16. Machine for packaging product as claimed in claim 14, and means for adjusting the distance between the hopper and the conveying means.

17. Machine for packaging product as claimed in claim 14, wherein said container includes a lid movable from a fully open position permitting product to be dispensed into the container to a closed position, said dispensing means includes rail means mounted over the conveying means for engaging said lid to hold said lid in a fully open position.

* * * * *